United States Patent [19]

Ordway

[11] 3,958,724

[45] May 25, 1976

[54] PRESSURE REGULATOR FOR SPRAY SYSTEMS

[75] Inventor: Richard S. Ordway, Haverhill, Mass.

[73] Assignee: Circle Machine Co., Inc., Seabrook, N.H.

[22] Filed: Sept. 9, 1974

[21] Appl. No.: 504,026

[52] U.S. Cl. ..... 222/318; 137/455; 239/127

[51] Int. Cl.[2] ..... B05B 1/30

[58] Field of Search ..... 239/124, 127, 411; 137/569, 455; 251/61.3, 61.4; 222/318

[56] References Cited

UNITED STATES PATENTS

| | | | |
|---|---|---|---|
| 2,304,906 | 12/1942 | Gibbs | 251/61.3 |
| 3,147,922 | 9/1964 | Warner | 239/127 |
| 3,194,502 | 7/1965 | West | 239/411 |
| 3,463,397 | 8/1969 | Mecklin et al. | 239/127 X |
| 3,816,025 | 6/1974 | O'Neill | 239/127 X |
| 3,831,849 | 8/1974 | Studinger | 239/127 |

*Primary Examiner*—John J. Love
*Assistant Examiner*—Michael Mar

[57] ABSTRACT

A regulator in a system for delivering a liquid under pressure to a sprayer maintains a substantially constant pressure in the system and a continuous flow back to the source with the volume of the circulating liquid inverse to the volume utilized by the sprayer.

13 Claims, 5 Drawing Figures

PRESSURE REGULATOR FOR SPRAY SYSTEMS

BACKGROUND OF THE INVENTION

Sprayers are used for many purposes and the delivery of the liquid thereto requires pump operated means to deliver the liquid under pressure from the source to the sprayer.

Hides and other sheet materials for use in the manufacture of footwear, by way of example, are often sprayed, as they are carried along a conveyor, with a paint or other coloring or finishing liquid. The systems utilize relatively large containers for the liquids in order to permit their operation without interruption for convenient lengths of time but presenting a problem with liquids, such as paints, that contain particles that will settle unless stirred from time-to-time. The pressure on the delivered liquid must be regulated and held substantially constant to ensure its effective application with minimum waste.

Efficient sprayers are disclosed in U.S. Pat. No. 3,426,973 and the co-pending application of Messrs. Ordway, Quinn and Comeau, Ser. No. 422,209, filed Dec. 6, 1973, now abandoned. Such sprayers have rotatable heads located above and centrally of the path of sheet materials and each head has a series of radial arms, each provided with a spray device. The sprayer disclosed in said application well illustrates the problem of pressure regulation since it provides for the delivery of spray from a plurality of sources and with the further provision that its spray devices may be operated either once or twice and for varying intervals on each rotation of the head.

THE PRESENT INVENTION

The general objective of the present invention is to provide pressure regulators and delivery systems including the pressure regulators that provide both for the maintenance of the liquid in the system under a constant, selected pressure and the circulation of some of the liquid back to the source container but with the volume of circulating liquid varying inversely with the flow through the first branch and usually and desirably continuous.

In accordance with the invention, this generally stated objective is attained with a pump controlled delivery system including a first branch conduit in communication with the sprayer and a second branch conduit in communication with the source and having a pressure regulator provided with a valve having means biasing it towards its open position and controlling the flow of the liquid through the second branch conduit. The regulator also has adjustable means operable to deliver air to so oppose the opening of the valve as to effect a position thereof that provides a constant, desired pressure in the liquid delivery system, which pressure coacts with the biasing means in urging the valve away from its closed position as the volume of liquid utilized by the sprayer decreases per unit of time.

Another objective of the invention is to provide a simple but efficient pressure regulator, an objective attained with a regulator having first and second sections each having a chamber opening towards the other and with means clamping them together with the margins of a diaphragm caught between them and separating the chambers, the diaphragm having a centrally located valve element. The first section has an inlet and an outlet with connections enabling it to be incorporated in the second branch conduit with the outlet having a seat in the chamber below the valve element which is yieldably urged away from its seat as by a spring. The second section has an inlet opening into its chamber so that when placed in communication with a source of air under a selected pressure, the action of the spring may be opposed to enable the selected liquid pressure to be established and constantly maintained within the system and with continuous circulation through the regulator but with the flow therethrough inverse to the flow through the sprayer.

BRIEF DESCRIPTION OF THE DRAWINGS

A preferred embodiment of the invention is illustrated by the accompanying drawings of which.

THE PREFERRED EMBODIMENT OF THE INVENTION

Figure 1:
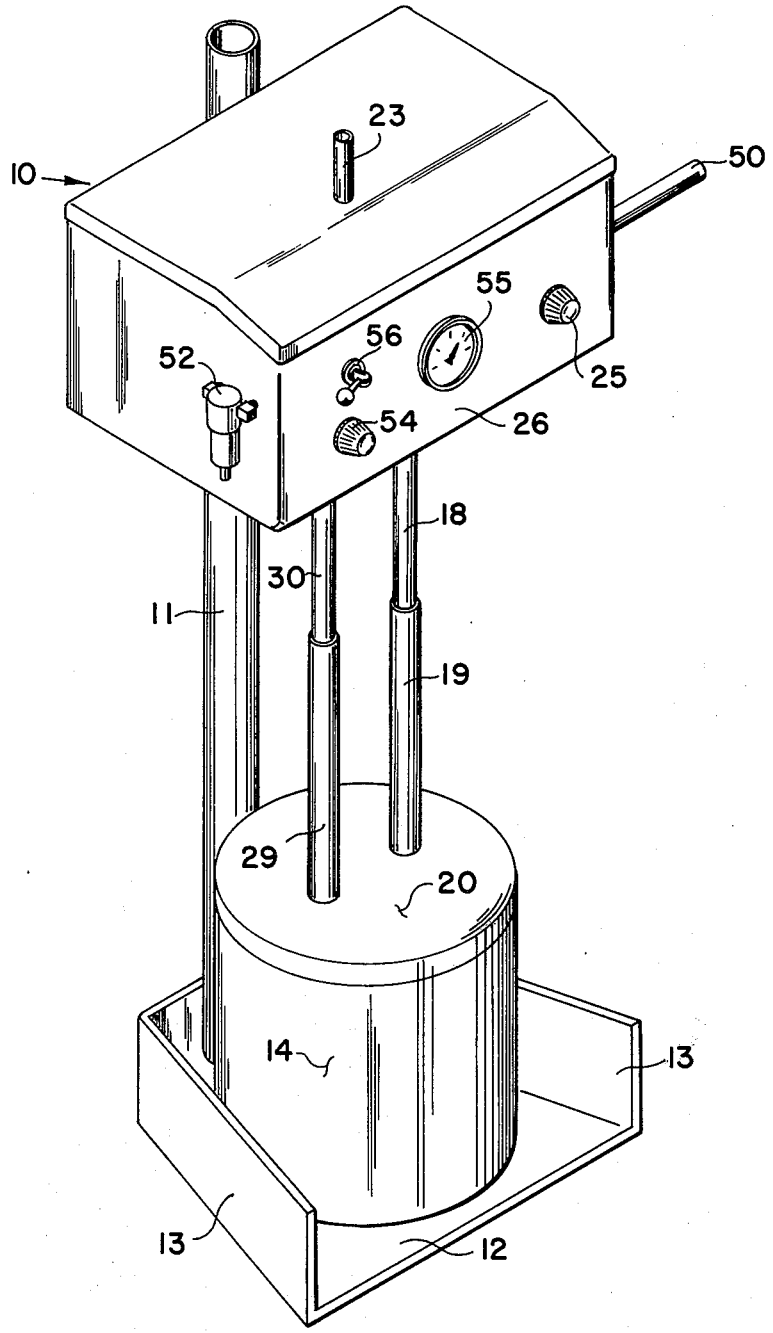
FIG. 1 is a front perspective view of the apparatus.

The apparatus, as illustrated by FIG. 1, has a cabinet 10 mounted on a support 11 to overlie the base 12 having outwardly flaring side walls 13 centering a container 14 for the liquid, a leather coloring or a leather treating liquid for examples.

A pump 15 driven by an electric motor 16 through a conventional transmission 17 at a desired speed is mounted in the cabinet 10 and has its intake conduit 18 provided with a flexible end section 19 extending downwardly into the container 14 through its cover 20. The delivery conduit 21 of the pump 15 includes a T 22 to which are connected first and second branch conduits 23 and 24, respectively. The motor circuit, not shown, has a switch with its control knob 25 mounted on the front panel 26 of the cabinet 10.

Figure 5:
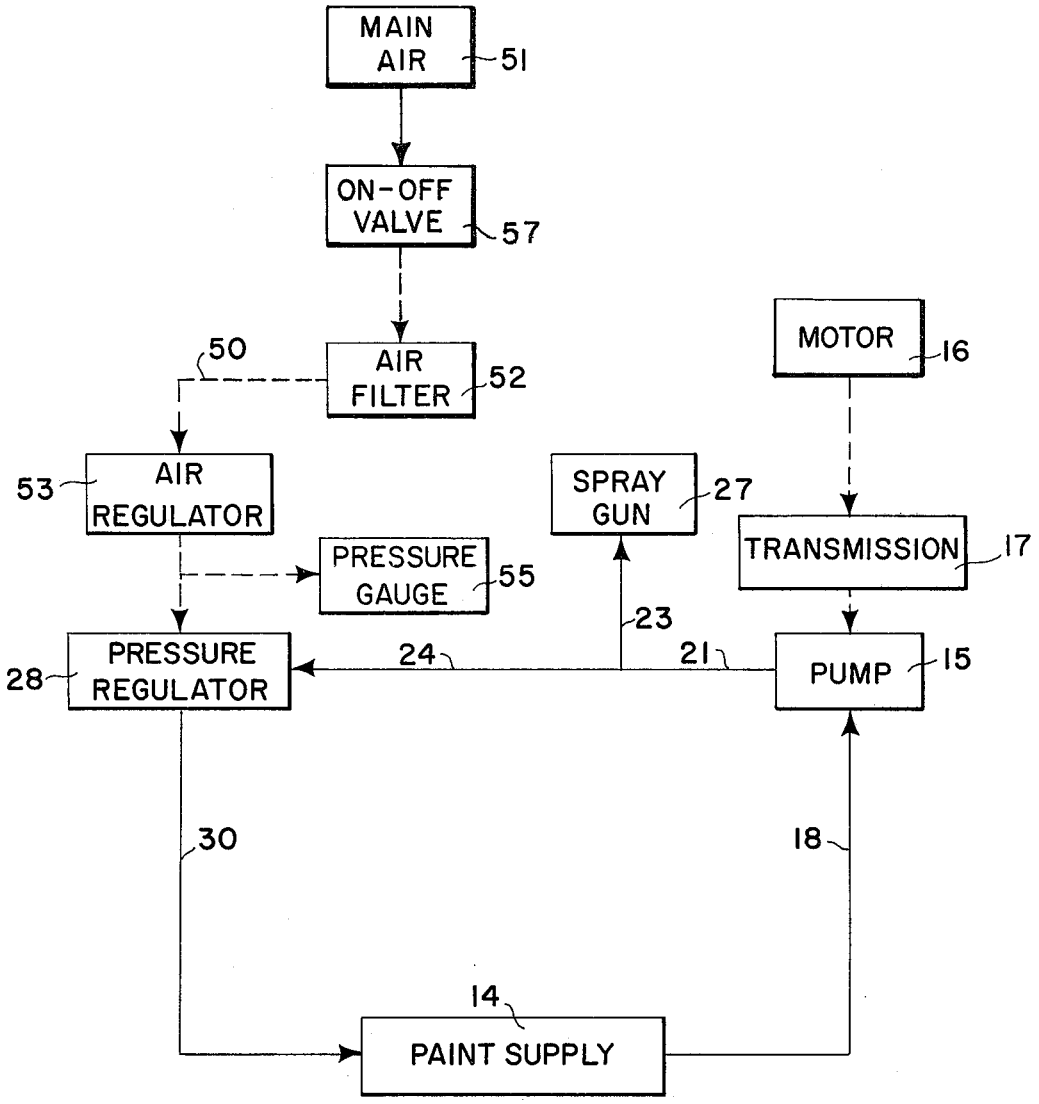
FIG. 5 is a block diagram of the components of the system.

The first branch conduit 23 is a delivery conduit and is connected to a sprayer, generally indicated at 27 in FIG. 5, which in practice is of the type shown in said U.S. Pat. No. 3,426,973 and in said application Ser. No. 422,209.

With any sprayer having its pump continuously operating pressure relief is necessary when the sprayer is not in service. With sprayers of the type shown in said patent and in said application, the volume utilized when the sprayer is in service may be variously varied to change the volume of liquid sprayed per unit of time further complicating pressure relief problems.

The second branch conduit 24 is a circulating conduit and includes a pressure regulator generally indicated at 28 and has a flexible end section 29 secured to the discharge section 30 from the regulator 28, the end section 29 extending downwardly into the container 14 through its cover 20.

Figure 2:
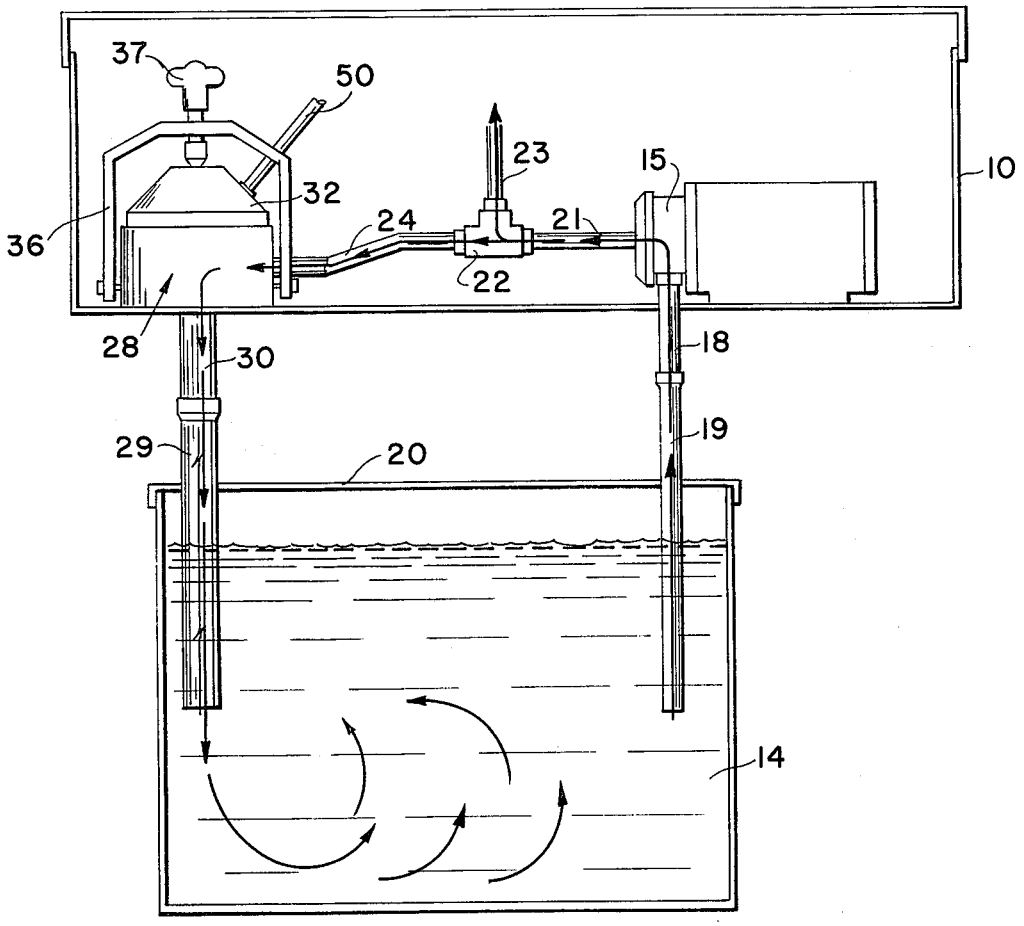
FIG. 2 is a somewhat schematic view showing the parts of the system housed within the cabinet and illustrating the circulation of the liquid to and from its container.
Figure 3:
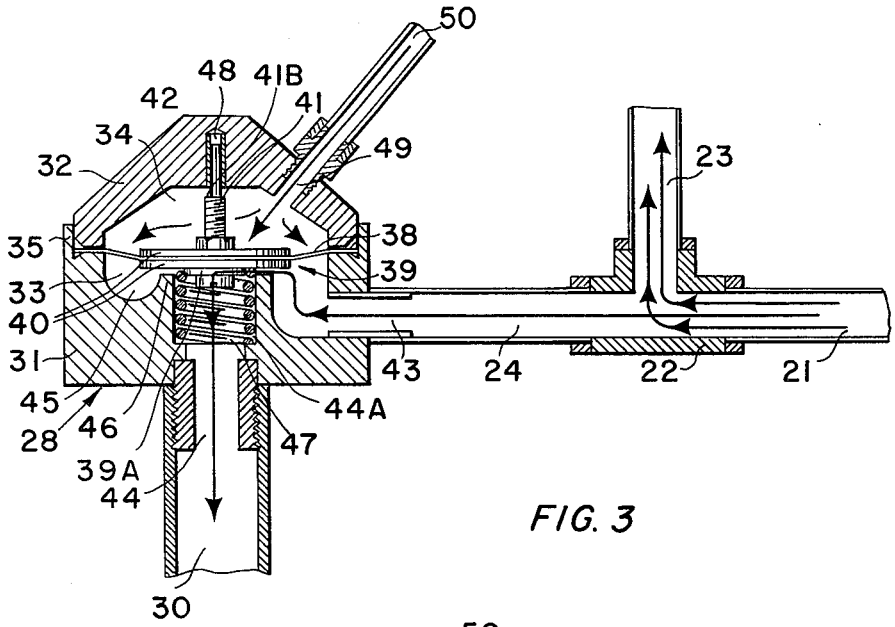
FIG. 3 is a section taken vertically through the pressure regulator with the regulating valve controlled by air to provide a constant desired liquid pressure in the delivery system and a continuous flow through the regulator and back into the container.
Figure 4:
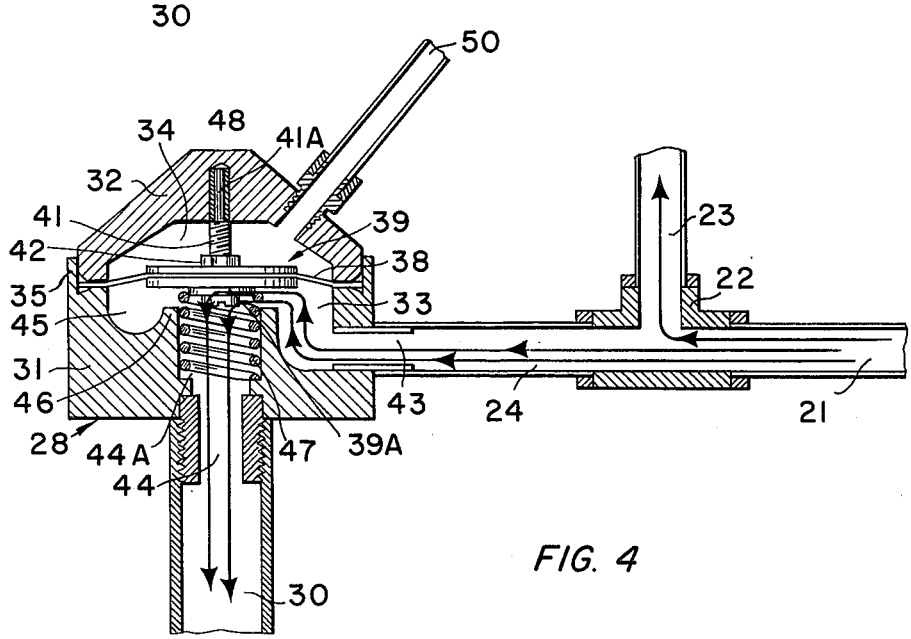
FIG. 4 is a like view with the valve positioned by the liquid pressure to increase the circulation of the liquid through the regulator in response to a decreased flow to the sprayer.

The pressure regulators 28, see FIGS. 3 and 4, has first and second sections 31 and 32, respectively. The sections 31 and 32 have chambers 33 and 34, respectively, opening towards each other and the section 31 has a rim 35 within which the section 32 fits. The section 31 has a releasable clamp 36, see FIG. 2, pivotally secured thereto with its free end extending over the top of the section 32 and including a clamping member 37 threaded therethrough into clamping engagement with said top thereby holding the section 32 seated against the section 31 with the margins of a flexible diaphragm 38 secured between them and separating the chambers 33 and 34. The diaphragm 38 has a central valve element generally indicated at 39 consisting of a pair of discs 40 between which the diaphragm is clamped with the discs connected by an upwardly disposed bolt 41 having a nut 42 threaded thereon.

The first section 31 has a laterally disposed inlet 43 to which the second branch conduit 24 is connected and a centrally located vertical outlet 44 to the lower end of which the discharge section 30 is connected. The upper end of the outlet 44 is surrounded by a channel 45 defining a valve seat 46 and of maximum depth where the inlet 43 opens into it and decreasing in depth to a minimum in a diametrically opposed area. The upper end of the outlet 44 has a counterbore 44A and opens through the valve seat 46 below and in axial alignment with the valve element 39. A coiled compression spring 47 is fitted within the counterbore 44A with its upper end bearing against the valve element 39 and held centered by a boss 39A on its undersurface.

The section 32 has a socket 48 in its chamber 34 in axial alignment with the bolt 41 and the bolt 41 has an end portion 41A of a diameter reduced to be a sliding fit in the socket 48 and to provide a stop shoulder 41B.

The section 32 also has an inlet 49 opening into its chamber 34 to which is connected a conduit 50 from a suitable air source 51 and the conduit has a filter 52 and an air pressure regulator 53 having a control knob 54 and a gauge 55 responsive to the pressure of the air delivered to the chamber 34. The knob 54 and the gauge 55 are both mounted on the front panel 26 of the cabinet 10 as is the control 56 of an "on-off" valve 57 in control of the air source.

In operation and with the container 14 full of the liquid to be used in treating the material, the pump 15 is started. As will be apparent from FIG. 3, and assuming the main valve of the sprayer to be closed, the pressure in the chamber 33 is such as to so flex the diaphragm 38 that the valve element 39 is unseated and the liquid is discharged back into the container 14 with a velocity such that it has an effective "stirring" action on the liquid therein and the pressure of the circulating liquid coacts with the spring 47 in urging the valve element 39 into its open position.

The liquid pressure in the system is adjusted by utilizing air from the air source 51 under pressure such that the spring 47 and the force of the circulating liquid is opposed to provide a continuous but restricted flow through the regulator 28 and a constant pressure in the branch conduit 23 that may be measured by the air pressure reflected by the gauge, the air pressure being desirably such that the flow through the regulator 28 is continuous even when the sprayer 27 is in service thus to ensure that the liquid in the container 14 is continuously stirred and that the conduit 24 and the pressure regulator 28 are in a condition making cleaning easier. As the volume of the liquid utilized by the sprayer 27 increases or decreases per unit of time of service, so does the volume that is discharged back to its source but in an inverse relationship.

I claim:

1. Apparatus for delivering liquid under pressure from a container to a sprayer, said apparatus comprising a delivery conduit including a pump, the intake end of said conduit disposable in the container, said delivery conduit including first and second branches, the first branch the delivery branch and the second branch including a discharge disposable in said container and a pressure regulator between said discharge and said first branch, said regulator including a valve in control of the liquid flow through said second branch, means yieldably urging said valve into its open position, means operable to oppose said opening means, one of said means being adjustable to enable, when said pump is in operation, said valve to be so positioned as to establish a desired liquid pressure in said first branch and a flow through the discharge, the pressure remaining substantially constant whether or not the sprayer is in service but the volume of liquid circulating through the regulator varying inversely with the flow through the first branch.

2. The apparatus of claim 1 in which it is the means operable to oppose the opening of the valve that is adjustable.

3. The apparatus of claim 1 in which the pressure regulator has first and second chambers, a diaphragm separates the chambers, the first chamber has an inlet and an outlet for the liquid, the valve includes a valve seat in the first chamber and a valve element carried by the diaphragm and engageable with the seat to block liquid flow through the first chamber, the means urging the valve into its open position is a spring in engagement with the valve element, and the means opposing the spring includes a source of air under pressure, in communication with the second chamber and adjustable means operable to vary the pressure of the air delivered thereto.

4. The apparatus of claim 3 and means to gauge the pressure within the delivery branch.

5. The apparatus of claim 4 in which the gauging means is responsive to the pressure of the air delivered to the second chamber.

6. The apparatus of claim 3 in which the valve seat and the valve element are located centrally of the first chamber, and the outlet is centrally of the valve seat.

7. The apparatus of claim 6 in which there is an annular seat in the outlet below the valve seat and the spring is backed thereby.

8. The apparatus of claim 6 in which the first chamber has a channel surrounding the valve seat that increases in depth from a minimum to a maximum at a diametrically opposite zone and the inlet opens into the channel in said zone.

9. The apparatus of claim 7 in which the second chamber has a socket in axial alignment with the valve seat and the valve element includes a member in axial alignment with the socket with one end portion slidably confined by the socket, thereby holding said valve element in axial alignment with said seat.

10. A pressure regulator for a liquid under pressure, said regulator comprising a first section, a second section, each section having a chamber opening towards the other section, means clamping said sections together, a diaphragm marginally caught by said sections and separating said chambers, said diaphragm including a central valve element, means connected to said valve element and to said second section holding said valve element in axial alignment with said seat as the valve element moves relative thereto, said second section chamber having an inlet connectable to a source of air under pressure, said first section chamber having an inlet for said liquid and an outlet, said outlet including a seat engageable by said valve element, a compression spring in said outlet in engagement with said valve element yieldably urging said valve element away from the seat whereby the pressure of the liquid can be controlled and maintained constant by a selected constant air pressure in the second section chamber that overcomes to a desired extent the action of the spring and the pressure of the liquid in the first section chamber.

11. The pressure regulator of claim 10 in which the first section has a channel surrounding and below the valve seat and defining the first chamber, and the means connected to said valve element and to said section include a socket in the second section opening into the second section chamber and a member attached to the valve element is slidably guided by said socket.

12. The pressure regulator of claim 11 in which the member entrant of the socket includes a shoulder limiting the extent to which the valve may be opened.

13. The pressure regulator of claim 11 in which the depth of the channel increases from a minimum to a maximum in a diametrically opposite zone and the inlet opens into the bottom of the channel in said zone.

* * * * *